US006007473A

United States Patent [19]

Koch et al.

[11] Patent Number: 6,007,473

[45] Date of Patent: Dec. 28, 1999

[54] CENTRIFUGE WITH REDUCED NOISE GENERATION

[75] Inventors: Michael Koch; Klaus Schütz, both of Osterode, Germany

[73] Assignee: Kendro Laboratory Products GmbH, Hanau, Germany

[21] Appl. No.: 09/039,613

[22] Filed: Mar. 16, 1998

[30] Foreign Application Priority Data

May 14, 1997 [DE] Germany ..... 197 19 959

[51] Int. Cl.[6] ..... B04B 7/02

[52] U.S. Cl. ..... 494/60; 494/82

[58] Field of Search ..... 494/16–20, 26, 494/31, 33, 43, 60, 82, 85; 210/144, 782; 422/72; 68/23.1, 23.3

[56] References Cited

U.S. PATENT DOCUMENTS

| | | | |
|---|---|---|---|
| 3,111,863 | 11/1963 | Filz | 494/60 |
| 3,148,146 | 9/1964 | Asnes et al. | 494/60 |
| 3,339,836 | 9/1967 | Mitchell et al. | 494/60 |
| 3,804,324 | 4/1974 | Sinn et al. . | |
| 4,079,882 | 3/1978 | Mizuyoshi et al. | 494/60 |
| 4,099,667 | 7/1978 | Uchida | 494/82 |
| 4,193,536 | 3/1980 | Kubota | 494/20 |
| 4,221,325 | 9/1980 | Kubota | 494/16 |
| 4,341,342 | 7/1982 | Hara | 494/60 |
| 5,490,830 | 2/1996 | Lovelady et al. | 494/60 |
| 5,502,342 | 3/1996 | Feldkamp et al. . | |

FOREIGN PATENT DOCUMENTS

| | | |
|---|---|---|
| 0 803 290 A1 | 4/1996 | European Pat. Off. . |
| 1 961 734 | 12/1968 | Germany . |
| 81536 | 6/1972 | Germany . |

*Primary Examiner*—Charles E. Cooley
*Attorney, Agent, or Firm*—Workman, Nydegger & Seeley

[57] ABSTRACT

A laboratory centrifuge includes a continuous metal plate comprising an underbody base plate having a rotor drive motor mounted thereon, an angled front screen which contains operating devices and display instruments, and a bending region which extends between the base plate and the front screen. At least two reciprocally parallel rows of decoupling slots are arranged between the bending region of the metal plate and the base plate. The decoupling slots form a meandering bar connection between the front screen and the base plate, by which noise generated due to imbalance at the rotor or structural noise in the direction of the front plate is considerably reduced. A conventional table centrifuge housing having a hinged lid and rotor bowl is fitted on the underbody.

20 Claims, 3 Drawing Sheets

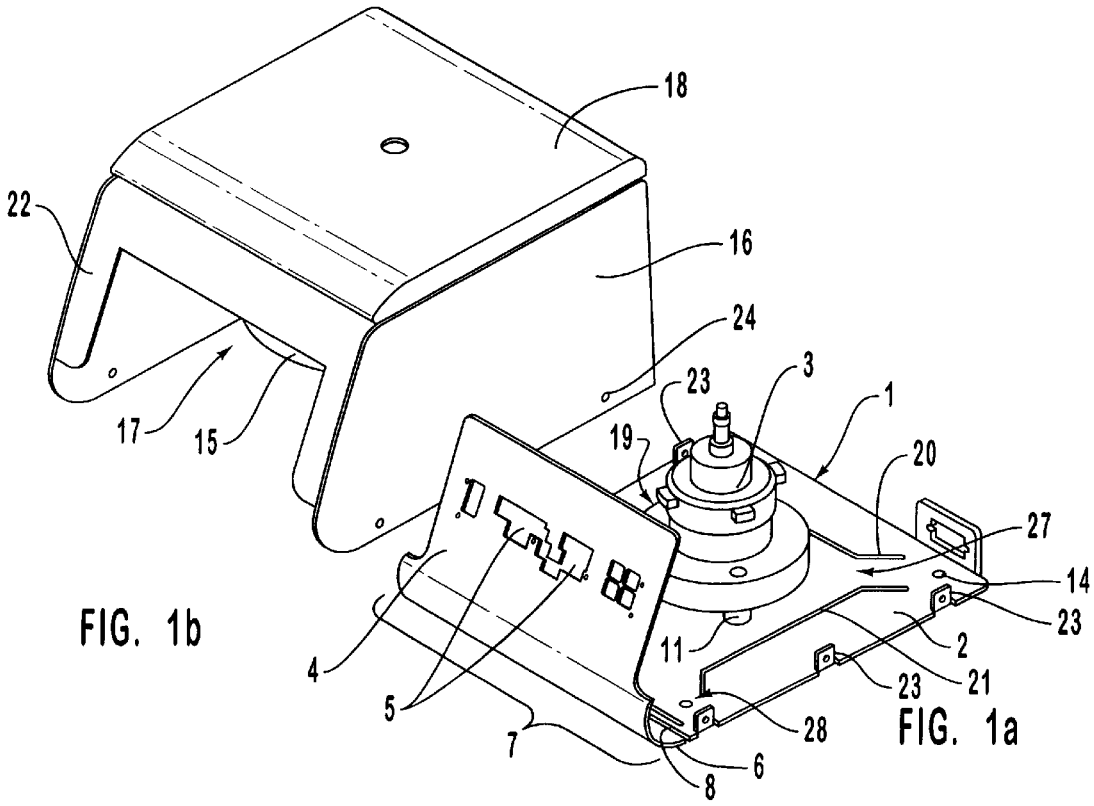
FIG. 1b
FIG. 1a
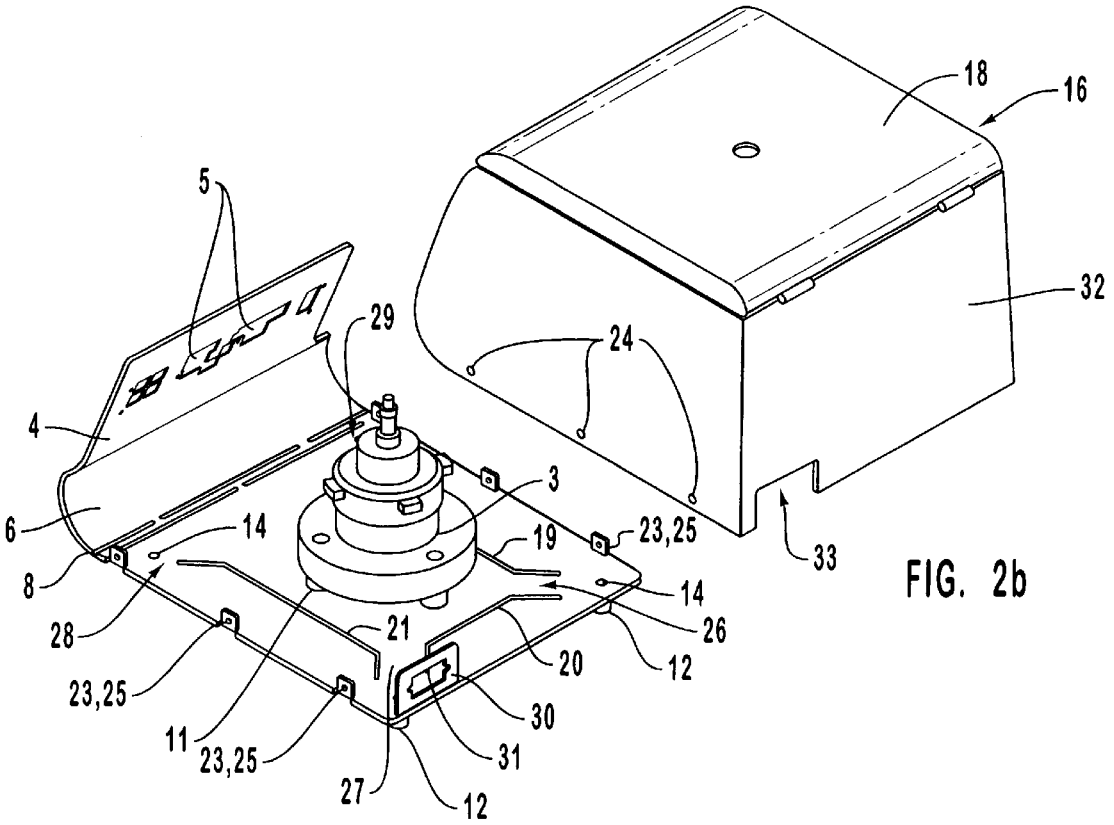
FIG. 2b
FIG. 2a

CENTRIFUGE WITH REDUCED NOISE GENERATION

This application claims foreign priority benefits under Section 119 of Title 35 of the United States Code to German Patent Application No. 197 19 959.3, Filed May 14, 1997, which is incorporated herein by specific reference.

BACKGROUND OF THE INVENTION

1. The Field of the Invention

The present invention relates to centrifuges and, more specifically, small table top centrifuges having minimal components and reduced noise generation.

2. Present State of the Art

Centrifuges, and particularly small table top centrifuges, are used in a variety of different environments for facilitating such services as separating substances of different densities, removing moisture from materials, and for simulating gravitational effects. A conventional table top centrifuge includes a housing enclosing a chamber. Disposed within the chamber is a motor which rotates a shaft. During operation, a substance, typically a solution, is secured by a rotor to the shaft. The shaft and rotor then spin rapidly which produces an increased gravitational force on the substance. Where the substance is a solution, the elements of the solution are separated by density.

Since centrifuges operate at high speeds which produce tremendous forces, the housing of conventional centrifuges is made of plates of high strength steel or other metal. From a manufacturing perspective, such centrifuges are time consuming to assemble and expensive in terms of material costs and labor costs. The resulting product is also relatively heavy, making it difficult to handle and expensive to transport. The high weight and cost are also a burden on the consumer. Furthermore, most conventional table top centrifuges are noisy during operation and thus uncomfortable to work around. Much of the noise is generated as a result of the centrifuge being unbalanced and thus vibrating during operation.

One attempt to solve some of the above problems is disclosed in German utility patent 72 24 033 and corresponding U.S. Pat. No. 3,804,324. The '324 patent discloses a table top centrifuge having a housing in which a motor and central rotor is positioned. The housing includes an encircling side wall having a base and a cover attached thereto. The housing is manufactured from structural high-strength foam, preferably polyurethane high-strength foam. To improve the stability of the centrifuge housing, a metal jacket is embedded within the walls of the housing. Although the metal jacket is perforated to reduce noise generation, the process of embedding the metal jacket during formation of the foamed walls is technically expensive.

A centrifuge is also disclosed in German Patent No. 1,961,734. The centrifuge of the '734 patent has a housing divided into a stationary lower part and an elastically suspended upper part. A centrifugal basket is seated within the upper part of the housing. In this configuration, vibrations of the rotor caused by imbalance are damped. This device, however, does not provide an axial connection of the drive motor and rotor. As a result, a relatively large amount of space is required to mount a separate drive motor as well as the accompanying drive connection. This required increased size makes the centrifuge less appealing to those seeking small table top centrifuges.

OBJECTS AND BRIEF SUMMARY OF THE INVENTION

Accordingly, it is an object of the present invention to provide improved centrifuges and particularly, small table top centrifuges.

Another object of the present invention is to provide centrifuges having minimal components that are easily manufactured and assembled.

Yet another object of the present invention is to provide improved centrifuges as above which minimize operation noise and particularly vibration noise.

Finally, another object of the present invention is to provide centrifuges as above that minimize the size and weight.

To achieve the foregoing objects, and in accordance with the invention as embodied and broadly described herein, a centrifuge is provided. The centrifuge includes a metal plate having a base plate, a front frame, and a bending portion extending therebetween. A housing part is mounted to the metal plate and includes a lid located on an upper surface that access a centrifuge bowl. A motor is mounted to the metal plate by elastic mounting devices. The motor rotates a rotor within the centrifuge bowl around a vertical axis.

In one embodiment, at least two reciprocally parallel rows of decoupling slots are provided between the bending region of the metal plate and the base plate. Each of the decoupling slots has at least one longitudinally extended decoupling slot. The fact that high torsional rigidity can be obtained between the base plate and front screen despite the decoupling slot proves to be advantageous. The decoupling slots are uniquely beneficial in that they significantly decrease the transfer of mechanical noise between the base plate and the front screen of the metal plate.

In another embodiment, the motor in the region of the base plate is surrounded on four side edges by decoupling slots. Elastic housing feet are provided between the decoupling slots. The housing feet divert the structural noise directly to the support or to the table plate of a laboratory table.

As a result of making the metal plate out of a continuous sheet, only a small number of basic components are required. The centrifuge can thus be constructed in a compact and inexpensive manner. Moreover, a reduction in weight compared with previous centrifuges is also possible.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 1*a* is a front perspective view of a metal plate having a front screen and a base plate on which a motor is located;

FIG. 1*b* is a front perspective view of a housing part attachable to the metal plate shown in FIG. 1;

FIG. 2*a* is a rear perspective view of the assembly shown in FIG. 1*a;*

FIG. 2*b* is a rear perspective view of the housing part shown in FIG. 1*b;*

DETAILED DESCRIPTION OF THE PREFERRED EMBODIMENTS

Figure 3:
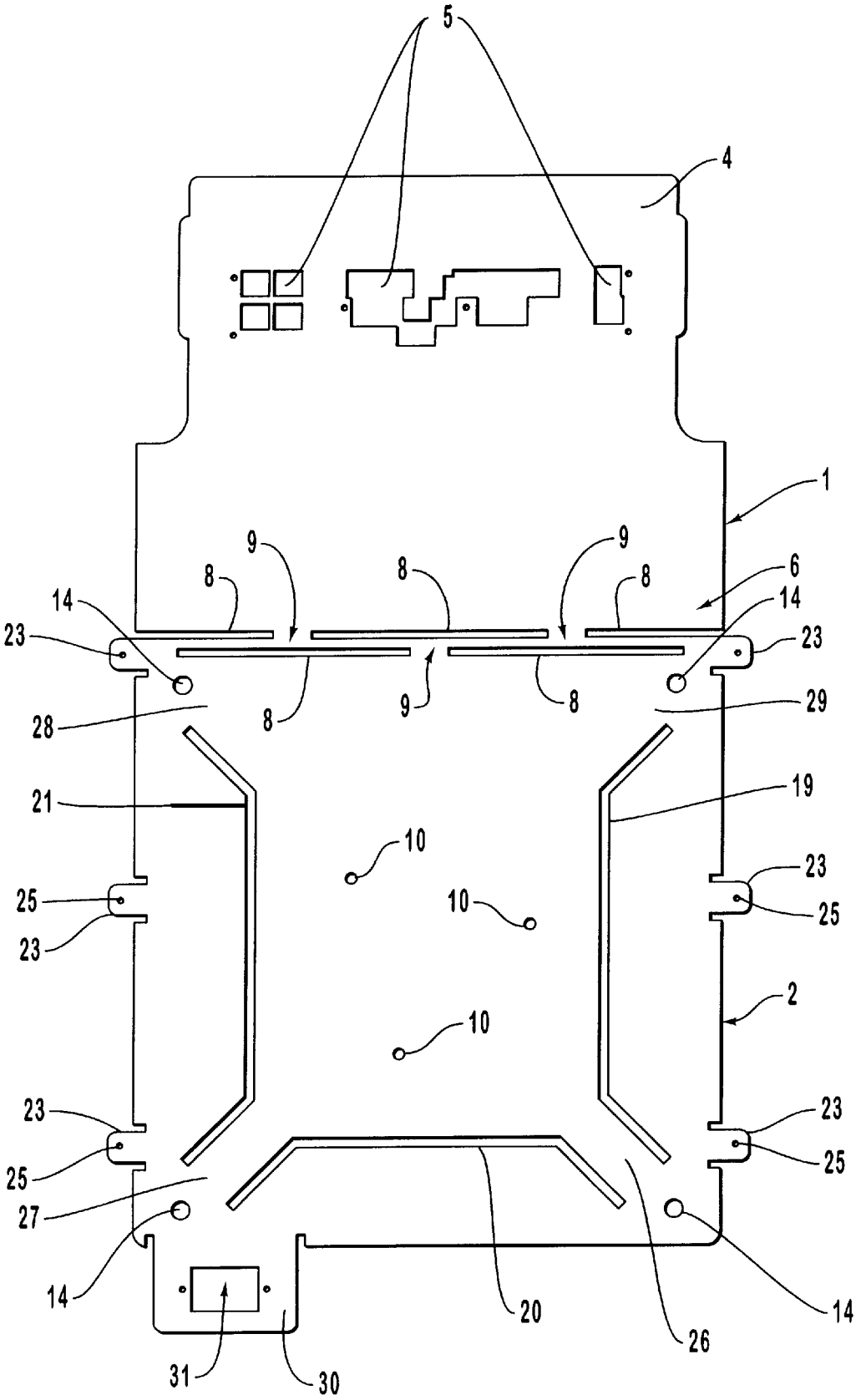
FIG. 3 is a top plan view of the metal plate shown in FIG. 1*a* which has not yet been bent.

In accordance with FIG. 1*a,* a metal plate 1 consists of three regions: a base plate 2 for mounting a drive motor 3, a front screen 4 with recesses 5 for receiving display elements and operating devices for the centrifuge, and a bending region 6 located between base plate 2 and front screen 4.

Base plate 2 and front screen 4 are each constructed as a plane. Both planes form an intersection of planes 7 and enclose an angle $\alpha$ in a range between 55° to 90° with 70° being more preferred. Drive motor 3 is connected to base plate 2 by means of three elastic mounting devices 11. In one embodiment, elastic mounting devices 11 are made from rubber cushions.

In accordance with FIG. 2*a,* base plate 2 is provided with four elastic feet 12 on its bottom surface for resting on a support, for example, a laboratory table. Feet 12 are attached by means of screws which extend through openings 14 of base plate 2. In base plate 2, recesses 8 are provided between the region of elastic mounting devices 11 of motor 3 and bending region 6. Recesses 8 are formed as decoupling slots and run parallel to intersection of planes 7. The decoupling slots or recesses 8 are displaced opposite each other in two reciprocally parallel rows, so that connecting bars located between them form a meandering bar connection between base plate 2 and bending region 6. The connecting bars are shown in more detail below by means of FIG. 3.

In accordance with FIG. 1*a,* additional decoupling slots 19, 20, and 21 are also provided on base plate 2. Decoupling slots 19, 20, and 21 partially surround drive motor 3. For example, decoupling slots 19 and 21 are located opposite each other on the sides of base plate 2 and are provided with mounting straps 23. Decoupling slot 20 is arranged on the back side of base plate 2. Bar-like connecting regions 26, 27, 28, and 29 represent the mechanical connection between the middle part of the base plate 2 having attachment points for the elastic mounting devices 11 and the outer region of base plate 2 having the openings 14 for the attachment of the elastic feet 12.

FIG. 1*b* shows a housing part 16 that can be mounted on base plate 2 and front screen 4. Housing part 16 has a front region 17 with a recess for front screen 4. Specifically, front region 17 of housing part 16 has a U-shaped front frame 22 which covers the upper edge and the two side edges of front screen 4. In this manner, users are protected from the risk of injury from the sharp edges of front screen 4. Housing part 16 also has holes 24 in both lower side regions, each at a distance from side mounting straps 23, through which screws are inserted to connect mounting straps 23 and housing part 16. In addition, a housing lid 18 is shown closed in this figure.

FIGS. 2*a* and 2*b* show the structural components of the centrifuge, as indicated by means of FIGS. 1*a* and 1*b,* from a different perspective. FIG. 2*a* shows the side mounting straps 23 with their openings 25. An additional strap 30 with an opening 31 for feeding the cable for the electrical power supply to the centrifuge is also provided on the back side of base plate 2. Back side 32 of housing part 16, which can be seen in FIG. 2*b,* has a corresponding recess 33 for feeding the cable through opening 31.

FIG. 3 shows metal plate 1 in an unbent state with base plate 2, bending region 6 and front screen 4 consisting of three regions. Drive motor 3 is mounted at openings 10 by means of elastic mounting devices 11. The motor region is surrounded on three sides by decoupling slots 19, 20, and 21. The decoupling slots 19, 20, and 21 are each arranged on the base plate between openings 14 for elastic feet 12, such that when viewed from drive motor 3, a bar-like connecting region 26, 27, 28 and 29 extends to elastic feet 12 at the decoupling slots 19, 20, 21.

As shown in FIG. 3, recesses 8 are constructed as decoupling slots and are arranged in two reciprocally parallel rows parallel to the bending region 6 or to the intersection of planes 7, in accordance with FIG. 1*a.* Recesses 8 are each offset with respect to each other so that symmetrically shown connecting bars 9 are connected to bending region 6 in a meandering manner. As a result, the transfer of structural noise from the region of base plate 2 to the region of the front screen 4 is significantly hindered.

The simple manufacture of the pattern of recesses 8 required for the decoupling proves to be especially advantageous.

On metal plate 1, provided with drive motor 3, display elements and operating devices are built into reliefs 5 and a front sheet is glued onto front screen 4. Housing part 16 is then fitted on base plate 2 in accordance with FIG. 1*b* or 2*b* so that front screen 4 fills out the open front region 17 of housing part 16. A rotor bowl 15, which is only partially represented in FIG. 1*b,* as well as housing lid 18 can be seen on housing part 16. Rotor bowl 15 is equipped with its own locking and safety devices which are not described in more detail here. More detailed information on the construction of such a centrifuge can be found, for example, in the introduction of the above mentioned U.S. Pat. No. 3,804,324.

Like rotor bowl 15, housing part 16 is preferably made from plastic, preferably PC+ABS (polycarbonate+acrylonitrile-butadiene styrene). The reciprocal locking of base plate 2 and housing part 16 takes place via screwing on. Metal plate 1 is preferably made from galvanized steel plate.

For the attachment of detachable housing part 16 to base plate 2, base plate 2 is provided with upwardly bent side straps 23 having openings 25. Screws introduced through housing holes 24 are engaged and fastened within openings 25.

A ratio of the length of bars 9 to the width of bars 9 in the range of 3:1 to 15:1 has proved to be especially favorable for damping the transfer of structural noise from the region of base plate 2 to front screen 4.

Figure 4:
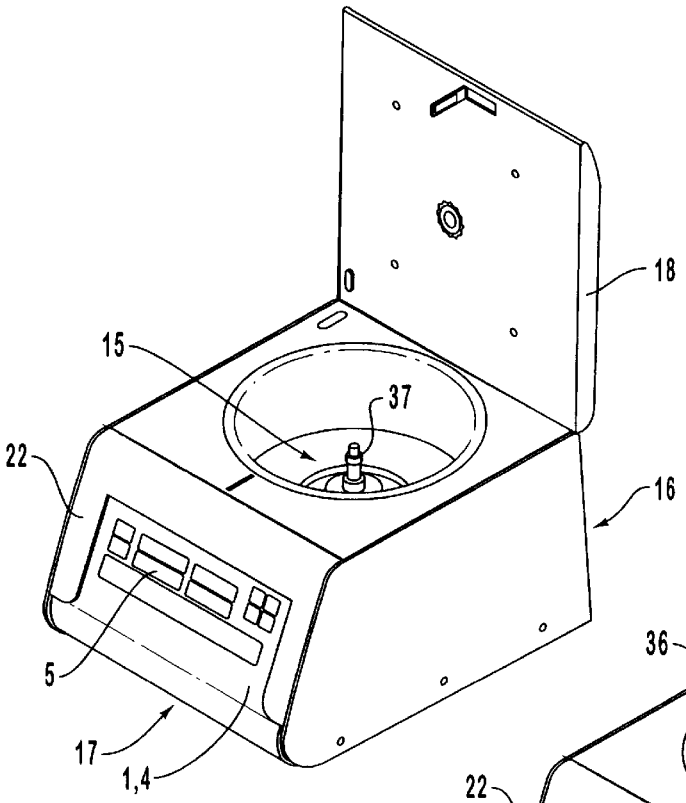
FIG. 4 is a front perspective view of the metal plate of FIG. 1*a* attached to the housing part of FIG. 1*b;*

FIG. 4 shows the centrifuge composed of metal plate 1 and housing part 16. The front sheet glued onto the sheet of the front screen 4 covers the display elements and operating devices which are inserted into the previous recesses 5. The front screen 4 is covered by a U-shaped front frame 22 in the front region 17. In this configuration, all edges of metal plate 1. i.e., front screen 4, bending region 6, and base plate 2, are covered by housing part 16. Accordingly, there is no risk of injury when the centrifuge is used. By means of FIG. 4, part of rotor bowl 15 as well as an upwardly projecting hub 37 of drive motor 3 can be seen. Housing lid 18 is open.

Figure 5:
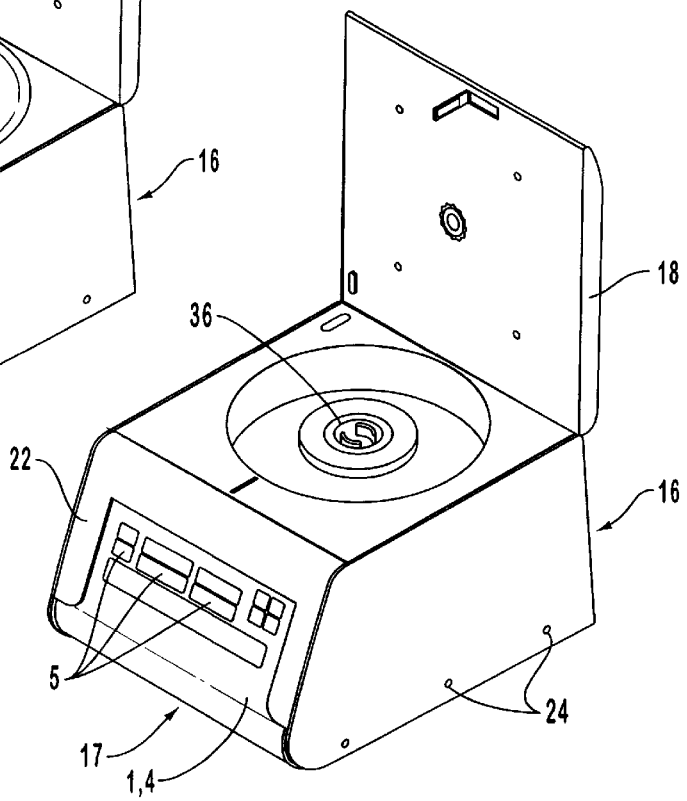
FIG. 5 is a front perspective view of a largely finished assembled centrifuge including the assembly shown in FIG. 4 with a rotor disposed within the chamber thereof.

FIG. 5 shows a similar arrangement as in FIG. 4. Depicted in FIG. 5, however, an installed rotor 36 can be seen.

Figure 6:
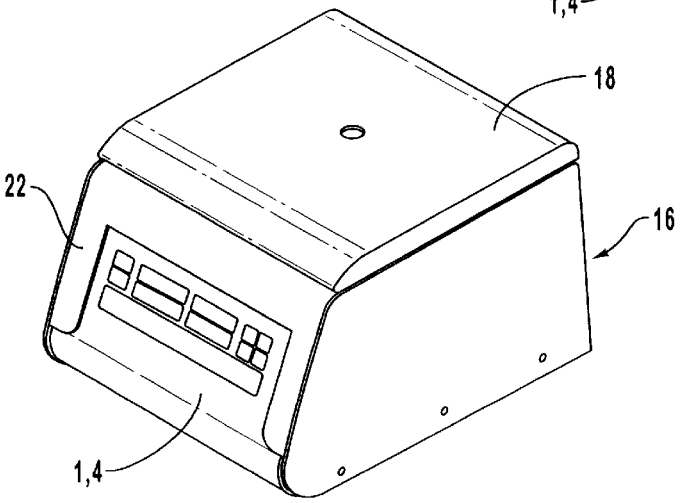
FIG. 6 is a front perspective view of the centrifuge shown in FIG. 5 with the lid closed.

FIG. 6 shows an apparatus in accordance with FIGS. 4 and FIG. 5, in which housing lid 18 is closed.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A centrifuge comprising:

(a) a metal plate including:

(i) a base plate having a motor region;

(ii) a front screen; and (iii) a bending region extending between the base plate and the front screen, the metal plate having at least two spaced apart decoupling slots that form a connecting bar therebetween, the connecting bar being positioned between the bending region and the motor region;

(b) a motor mounted to the base plate at the motor region, the motor having a rotatable hub;

(c) a rotor mounted to the hub; and (d) a housing part mounted to the metal plate so as to substantially enclose the rotor, the housing part including a lid enabling access to the rotor.

2. A centrifuge as recited in claim 1, wherein the base plate and the front screen are planar.

3. A centrifuge as recited in claim 2, wherein the plane of the base plate and the plane of the front screen intersect to form an inside angle in the range of 55° to 90°.

4. A centrifuge as recited in claim 1, further comprising a plurality of reciprocally parallel rows of decoupling slots transversely extending across the metal plate between the front screen and the motor region.

5. A centrifuge as recited in claim 4, wherein the decoupling slots are offset from each other so that meandering connecting bars run between the motor region of the base plate and the bending region.

6. A centrifuge as recited in claim 1, wherein the connecting bar has a length to width ratio in a range of 3:1 to 15:1.

7. A centrifuge as recited in claim 1, further comprising a plurality of additional decoupling slots extending through the base plate and partially surrounding the motor.

8. A centrifuge comprising:

(a) a metal plate including:

(i) a base plate having a motor region and a surrounding outer region, a plurality of elongated decoupling slots extend through the metal plate between the motor region and the outer region so as to partially surround the motor region;

(ii) a front screen; and (iii) a bending region extending between the base plate and the front screen;

(b) a motor mounted to the base plate at the motor region, the motor having a rotatable hub;

(c) a rotor mounted to the hub; and (d) a housing part mounted to the metal plate so as to substantially enclose the rotor, the housing part including a lid enabling access to the rotor.

9. A centrifuge as recited in claim 8, wherein the base plate has a top surface and a bottom surface, a plurality of elastic support feet being mounted to the outer region of the base plate at the bottom surface thereof.

10. A centrifuge as recited in claim 9, wherein the metal plate further comprises a plurality of connecting regions extending between the motor region and the outer region, each elastic support foot being disposed in a corresponding plane that extends from the support foot to the motor region through a corresponding connecting region without intersecting one of the plurality of decoupling slots.

11. A centrifuge as recited in claim 8, further comprising a first row of spaced apart decoupling slots extending through the metal plate, the first row transversely extending across the metal plate between the motor region and the front screen.

12. A centrifuge as recited in claim 11, wherein the spaced apart decoupling slots of the first row bound a connecting bar therebetween, the connecting bar having a length to width ratio in the range of 3:1 to 15:1.

13. A centrifuge as recited in claim 11, further comprising a second row of spaced apart decoupling slots extending through the metal plate, the second row running substantially parallel to the first row with the decoupling slots of the second row being staggered relative to the decoupling slots of the first row.

14. A centrifuge housing comprising:

(a) a continuous metal plate including:

(i) a base plate having a motor region;

(ii) a front screen; and (iii) a bending region extending between the base plate and the front screen, the base plate and the front screen each being planar, the plane of the base plate and the plane of the front screen intersecting to form an inside angle in a range between about 55° to about 70°;

(b) means for hindering the transfer of structural noise between the base plate and the front screen;

(c) a motor mounted to the base plate at the motor region, the motor having a rotatable hub;

(d) a rotor mounted to the hub; and (e) a housing part mounted to the metal plate so as to substantially enclose the rotor, the housing part including a lid enabling access to the rotor.

15. A centrifuge as recited in claim 14, wherein the means for hindering the transfer of structural noise comprises a first row of spaced part decoupling slots extending through the metal plate, the first row transversely extending across the metal plate between the motor region and the front screen.

16. A centrifuge as recited in claim 15, wherein the spaced apart decoupling slots bound a connecting bar therebetween, the connecting bar having a length to width ratio in the range of 3:1 to 15:1.

17. A centrifuge as recited in claim 15, further comprising a second row of spaced part decoupling slots extending through the metal plate, the second row running substantially parallel to the first row with the decoupling slots of the second row being staggered relative to the decoupling slots of the first row.

18. A centrifuge as recited in claim 14, wherein the base plate further comprises an outer region surrounding the motor region, a plurality of elongated decoupling slots extend through the metal plate between the motor region and the outer region so as to partially surround the motor region.

19. A centrifuge as recited in claim 14, wherein the housing part comprises a front region, a back side and opposing sidewalls extending therebetween, the front region comprising a U-shaped front frame covering the outside edge of the front screen of the metal plate.

20. A centrifuge housing comprising:

(a) a continuous metal plate including:

(i) a base plate having a motor region;

(ii) a front screen; and (iii) a bending region extending between the base plate and the front screen;

(b) means for hindering the transfer of structural noise between the base plate and the front screen;

(c) a motor mounted to the base plate at the motor region, the motor having a rotatable hub;

(d) a rotor mounted to the hub; and (e) a housing part mounted to the metal plate so as to substantially enclose the rotor, the housing part including a lid enabling access to the rotor, a front region, a back side, and opposing sidewalls extending therebetween, the front region comprising a U-shaped front frame covering the outside edge of the front screen of the metal plate.

* * * * *

UNITED STATES PATENT AND TRADEMARK OFFICE

CERTIFICATE OF CORRECTION

PATENT NO. : 6,007,473

DATED : Dec. 28, 1999

INVENTOR(S) : Michael Koch; Klaus Schutz

It is certified that error appears in the above-identified patent and that said Letters Patent are hereby corrected as shown below:

Col. 6, line 45, after "spaced" change "part" to --apart--

Col. 6, line 53, after "spaced" change "part" to --apart--

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*